US006330895B1

(12) United States Patent
Carpenter et al.

(10) Patent No.: US 6,330,895 B1
(45) Date of Patent: Dec. 18, 2001

(54) LOG FLAKING AND LOADING METHOD AND APPARATUS

(75) Inventors: Charles T. Carpenter; Robert M. Bayly, both of Lake Oswego; Bradley R. Stager, Beaverton, all of OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 09/574,725

(22) Filed: May 18, 2000

(51) Int. Cl.[7] ..... B27L 11/00; B27M 1/08

(52) U.S. Cl. ..... 144/373; 144/3.1; 144/4.9; 144/114.1; 144/116; 144/174; 144/242.1; 144/245.2; 144/245.4; 144/375

(58) Field of Search ..... 144/3.1, 4.9, 39, 144/114.1, 116, 124, 125, 126, 127.1, 134.1, 162.1, 172, 173, 174, 242.1, 363, 373, 374, 375, 245.1, 245.2, 245.4, 230

(56) References Cited

U.S. PATENT DOCUMENTS 2,696,856 * 12/1954 McCoy ..... 144/116
3,326,252 * 6/1967 Pease ..... 144/4.9
3,346,028 * 10/1967 Mitten ..... 144/374
3,454,063 * 7/1969 Mitten ..... 144/3.1
4,219,056 * 8/1980 Lindstrom ..... 144/4.9
4,230,163 * 10/1980 Barton ..... 144/116
4,697,626 * 10/1987 Arasmith ..... 144/373

* cited by examiner

*Primary Examiner*—W. Donald Bray
(74) *Attorney, Agent, or Firm*—Birdwell, Janke & Durando, PLC

(57) ABSTRACT

A log flaking and loading method and apparatus. First and second pairs of cutting heads have cutting heads spaced apart to receive a log passed therebetween and thereby to cut two substantially parallel sides. The log is first cut by the first pair of cutting heads, rotated about its elongate axis, and cut by the second pair of cutting heads to produce a four-sided cant. The logs are preferably stored ahead of the first pair of cutting heads in corresponding carriers, which are preferably held in a magazine for dispensing the loaded carriers.

14 Claims, 8 Drawing Sheets

10
18
e
FLOW
14a
14b
20
$a_1$
$a_2$
D
$d_{start}$

LOG FLAKING AND LOADING METHOD AND APPARATUS

BACKGROUND OF THE INVENTION

The present invention relates to a log flaking and loading method and apparatus, particularly for producing four-sided cants from logs by cutting flakes or strands.

Wood flaking is a fundamental process in the production of wood products from raw logs. Particularly, flaking machines are used to produce a relatively smooth lumber finish on the log by cutting flakes therefrom. The flakes may be of bulk dimensions, or they may be produced in thin, wafer-like sheets, such as to be used in the production of oriented strand board ("OSB"), a wood product commonly employed as a substitute for plywood in which wafer-like "flakes or strands," typically about 0.020" thick, are pressed together and glued into sheet form. In such applications, it is desirable that the flakes or strands be strong and robust.

The flaking machines employ cutting heads of a variety of different configurations. Commonly, the cutting head is a rotating drum or disc carrying a plurality of knives around its circumference. The log is forced against the cutting head while the cutting head turns and which, thereby, cuts the flakes or strands. This produces flakes or strands that are not as strong and robust as is desirable.

The flaking machines are typically used to cut a substantially plane surface that is parallel to the elongate axis of the log. The portion of the log remaining after such cutting is termed a "cant." Where only one surface is cut, the cant is "one-sided." A "four-sided" cant is typically a finished or nearly finished piece of lumber, such as a 4×4 stud.

Particularly when producing lumber from logs of small diameter, it is desirable to process the log directly to form a four sided cant. It is most efficient to produce flakes or strands of sufficiently high quality for, e.g., OSB products in the same operation as that used to produce the four sided cant. It has not apparent, however, that this has been recognized in the prior art.

Four-sided cants are often produced by passing the log by a single cutting head four times. Such a method is time consuming, however. To increase throughput, a drum-style cutting head that is substantially as long as the length of log or other work piece being cut may be employed. The log is rotated slowly as the lathe head is rotated rapidly, the spacing between the lathe head and log being controlled by contact between a cam on the one and a cam follower on the other wherein the cam has the desired cross-sectional shape of the finished cant, See Peter Koch, "Development of the Shaping Lathe Headrig", U.S. Department of Agriculture Forest Service Research Paper SO-98 (1974), incorporated herein by reference in its entirety. While the concept of the shaping lathe headrig could be used to increase the speed of four sided cant production, this would remain limited by the requirement to "machine" all four sides of the log with a single cutting head.

Accordingly, there is a need for a log flaking and loading method and apparatus that provides for producing higher quality flakes or strands for use in wood products as a result of producing four sided cants, and for increasing the production speed of producing the four sided cants.

SUMMARY OF THE INVENTION

A log flaking and loading method and apparatus according to the present invention solves the aforementioned problem and meets the aforementioned need by providing first and second pairs of cutting heads, the cutting heads of each pair being spaced apart to receive a log disposed therebetween and being adapted to move inwardly, toward one another, to cut two curved sides in the log. The heads are then fixed in position, and the log is moved in a perpendicular direction, to plane the curved sides. The log may then be rotated 90 degrees about its elongate axis and the process repeated, either with the same cutting heads or with an additional pair of cutting heads. Flakes or strands removed from the log have a generally high quality in terms of strength and robustness.

For processing a number of logs, each log is provided an associated carrier for carrying the log through the cutting heads. The carriers include spaced adjustable stops for making contact with the log and straightening it along its length. Loaded carriers are stored in a first magazine for feeding the cutting heads. The carriers are adapted to be picked from the magazine, placed between the cutting heads and moved as described above for planing.

In addition, a second, like, magazine is preferably provided for filling with loaded carriers while the first magazine is being emptied. After the first magazine is emptied and the second magazine filled, the first magazine is replaced with the second magazine.

In another aspect of the invention, a log is rotated against a rotating cutting head so as to peel flakes or strands from the outer surface of the log, leaving the log with a circular cross section as it is being cut. This has been found to produce flakes or strands of highest quality in terms of strength and robustness.

Therefore, it is a principal object of the present invention to provide a novel and improved log flaking and loading method and apparatus.

It is another object of the present invention to provide a log flaking and loading method and apparatus that provides for producing higher quality flakes or strands for use in wood products.

It is still another object of the present invention to provide a log flaking and loading method and apparatus that provides for producing higher quality flakes or strands for use in wood products in the same operation in which four sided cants are produced.

It is yet another object of the present invention to provide a log flaking and loading method and apparatus that provides for producing a single four sided cant at a higher rate of speed.

It is a further object of the present invention to provide a log flaking and loading method and apparatus that provides for producing a plurality of four sided cants at a higher rate of speed.

It is still a further object of the present invention to provide a log flaking and loading method and apparatus that provides for producing flakes or strands of the highest quality for use in wood products.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENTS

Figures 1, 2:
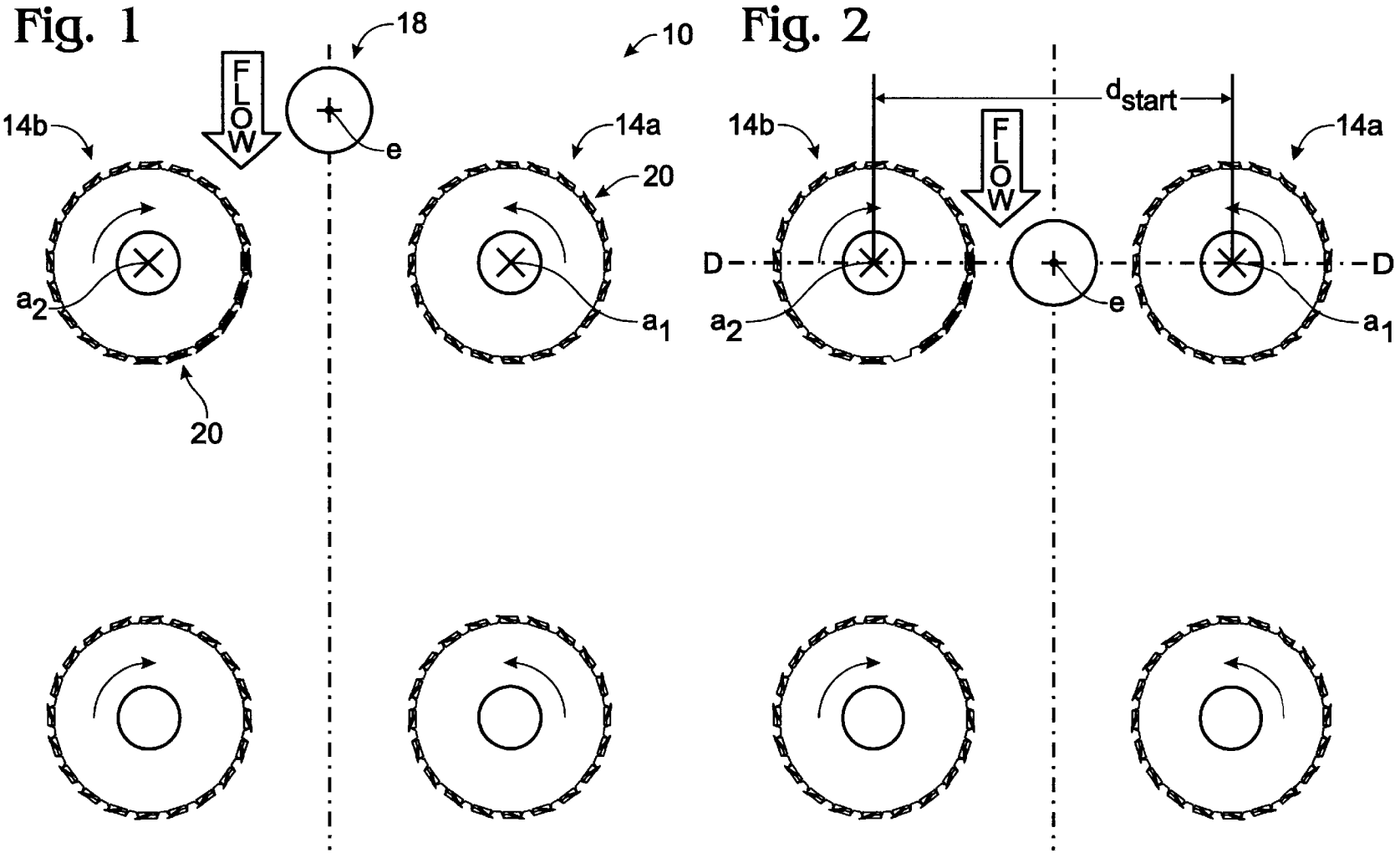
FIG. 1 is an end view of a log and cutting heads for producing a four-sided cant from the log according to the present invention in a first position of the log.
FIG. 2 is an end view of the log and cutting heads of FIG. 1 according to the present invention in a second position of the log.
Figure 13:
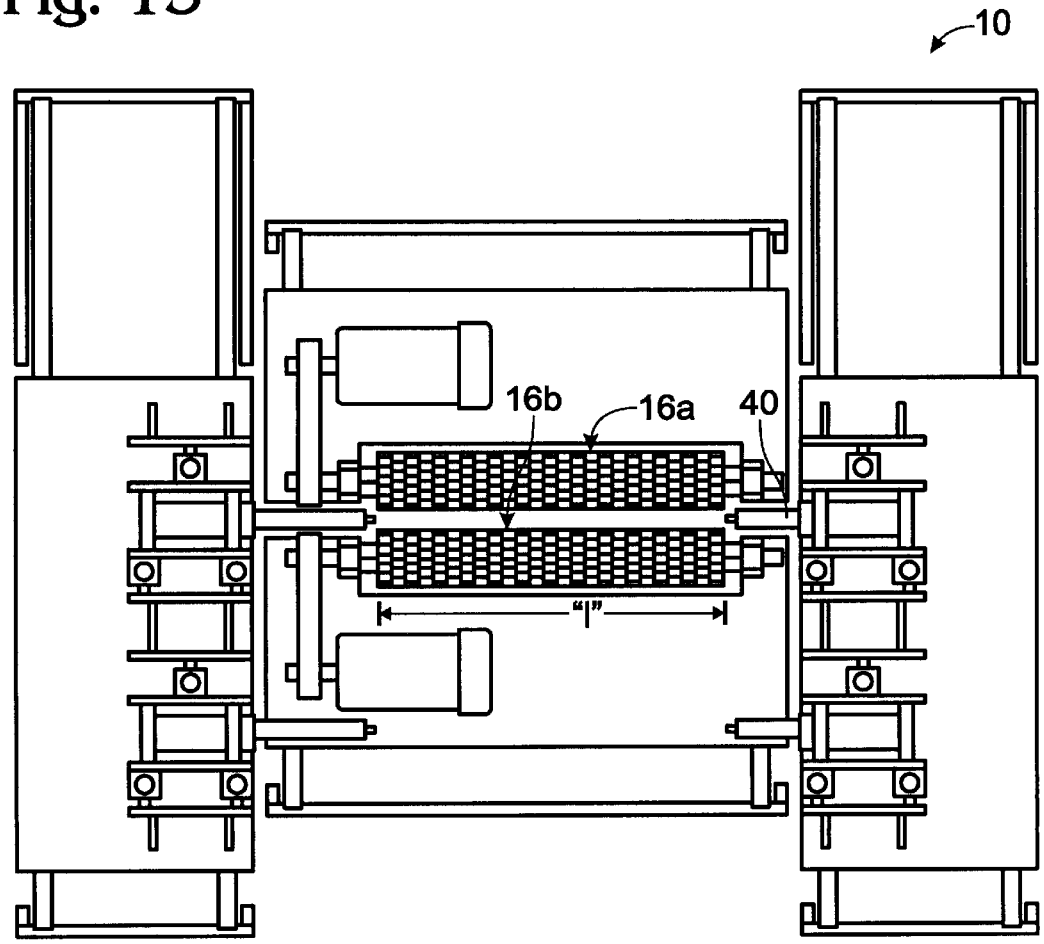
FIG. 13 is a plan view of an apparatus for producing a plurality of the four-sided cant of FIG. 1 according to the present invention.

Referring to FIG. 1, an apparatus 10 for producing a four-sided cant according to the present invention is shown. A first pair of cutting heads 14a, 14*b* are provided for cutting two sides on a log 18. The log and cutting heads are depicted end-on, in a plane perpendicular to the elongate axis "e" of the log. The cutting heads rotate about respective axes "a1" and "a2" that are parallel to the log axis "e". The cutting heads carry one or more knives 20 around their circumferences. Preferably, the cutting heads rotate in opposite directions; however, this is not essential. The log is fed to the cutting heads in the direction of the arrow. The cutting heads are preferably provided as cylinders extending a distance "1" (FIG. 13) that is at least the length of the log.

Turning to FIG. 2, the log 18 has translated to a position between the cutting heads wherein the elongate axis "e" of the log lies in the same plane as the axes "a1" and "a2", which shows as a line D—D in the Figure. A starting distance "dstart" between the cutting heads 14 along the line D—D represents the starting distance that the cutting heads are spaced apart from one another.

Figure 3:
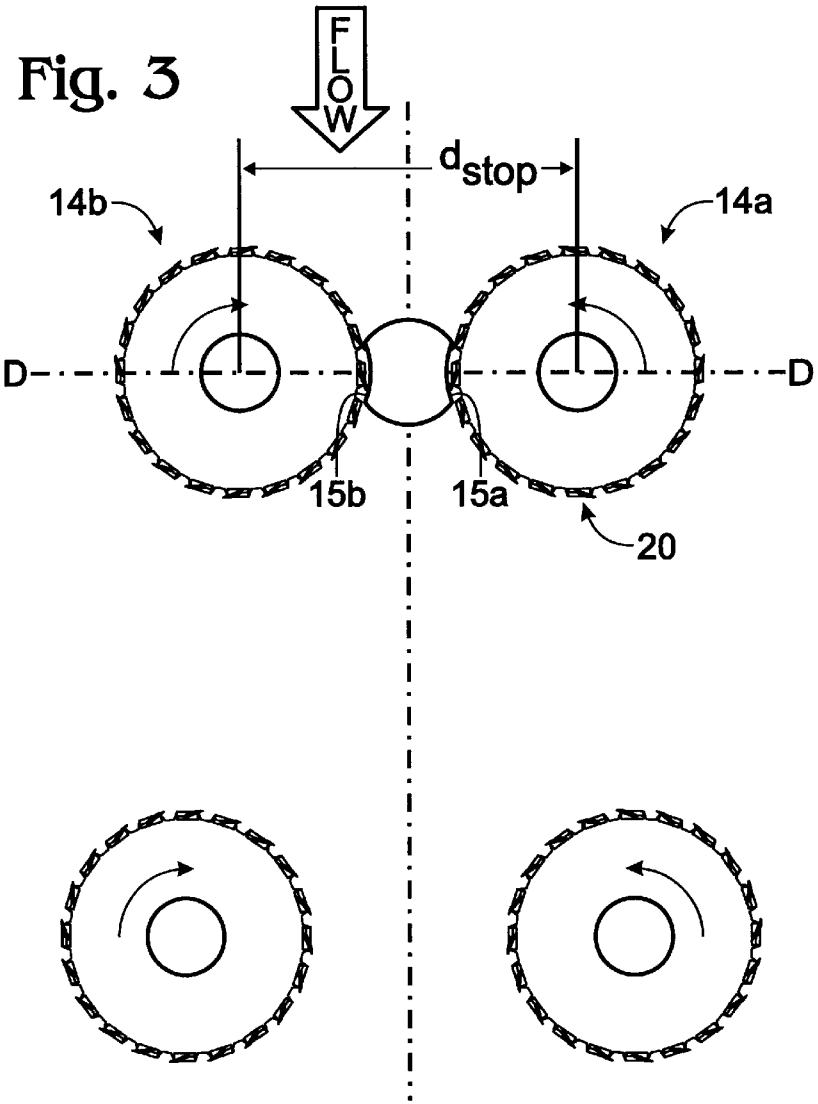
FIG. 3 is an end view of the log and cutting heads of FIG. 1 according to the present invention in a third position of the log.

Turning to FIG. 3, the cutting heads 14*a* and 14*b* translate toward one another along the line D—D to decrease the distance therebetween from "dstart" to "dstop" so that the cutting heads are positioned to cut two curved surfaces 15*a*, 15*b* into opposite sides of the log with the knives 20 and stop translating.

Theoretically, it is possible to translate the two heads and the log in a number of different ways to accomplish the relative translation shown in FIG. 3; however, in practice the log preferably remains in a fixed position and each head translates an equal distance toward the other.

Figure 4:
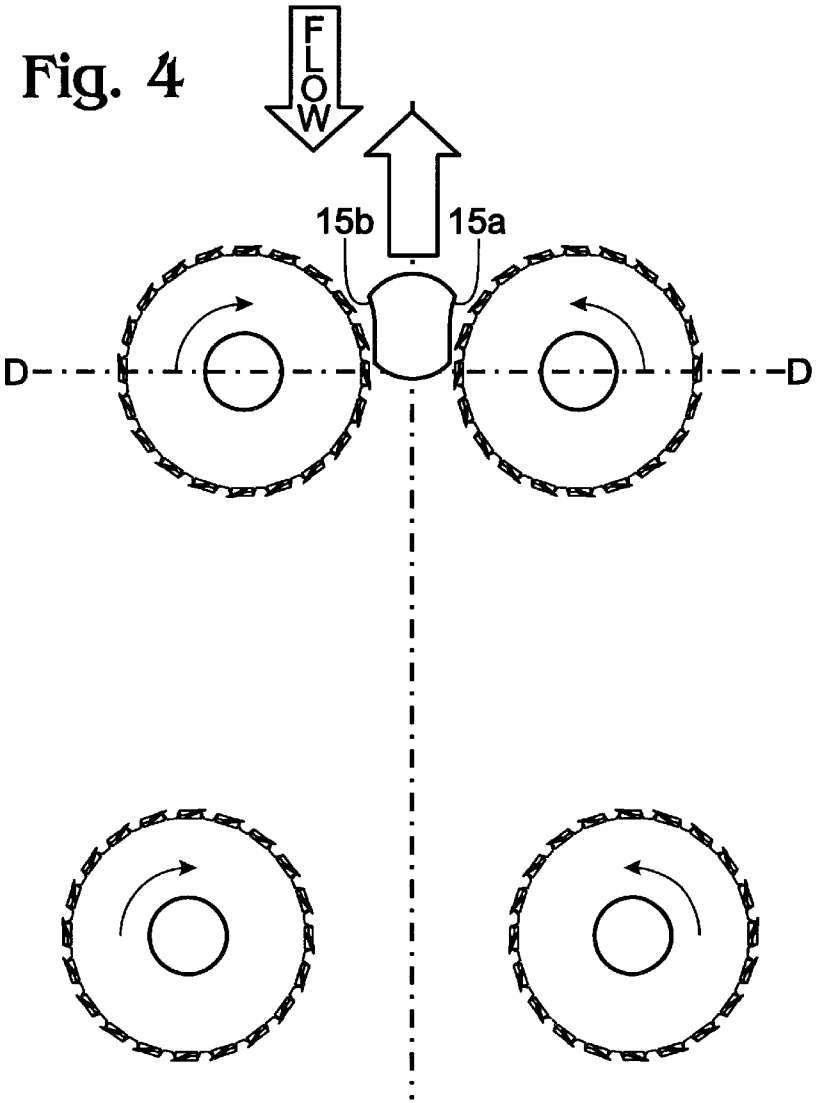
FIG. 4 is an end view of the log and cutting heads of FIG. 1 according to the present invention in a fourth position of the log.

Turning to FIG. 4, with the cutting heads 14 still stopped at dstop, the log 18 is translated in a first direction that is perpendicular to the line D—D. The first direction is shown as being upward in the Figure. This movement planes the curved surfaces 15 over their bottom halves as shown.

Figure 5:
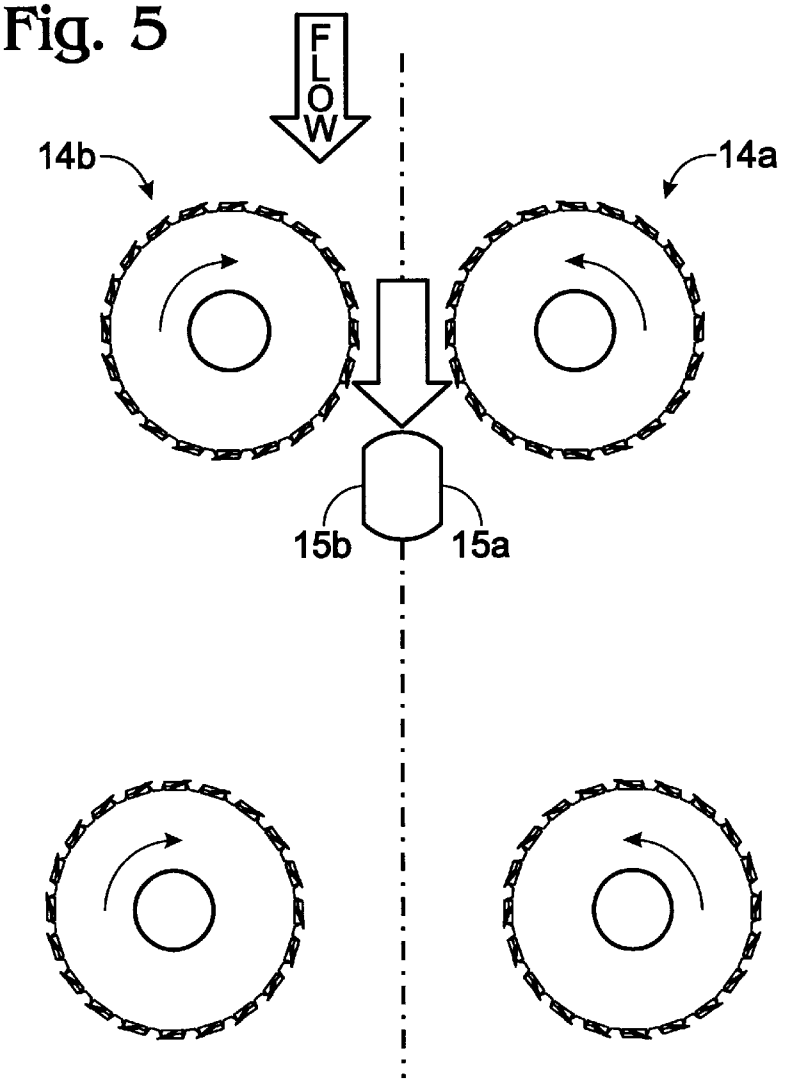
FIG. 5 is an end view of the log and cutting heads of FIG. 1 according to the present invention in a fifth position of the log.

Turning to FIG. 5, with the cutting heads 14 still stopped at dstop, the log 18 is translated in the reverse direction to that shown in FIG. 4. The reverse direction is shown as being downward in the Figure. This movement planes the remaining portions of the curved surfaces 15, so that the surfaces 15 are flat and parallel as shown.

It is possible to translate the two heads rather than the log to accomplish the relative translation shown in FIG. 5; however, preferably, the log is moved in the directions indicated while the position of the heads remains fixed.

Figure 6:
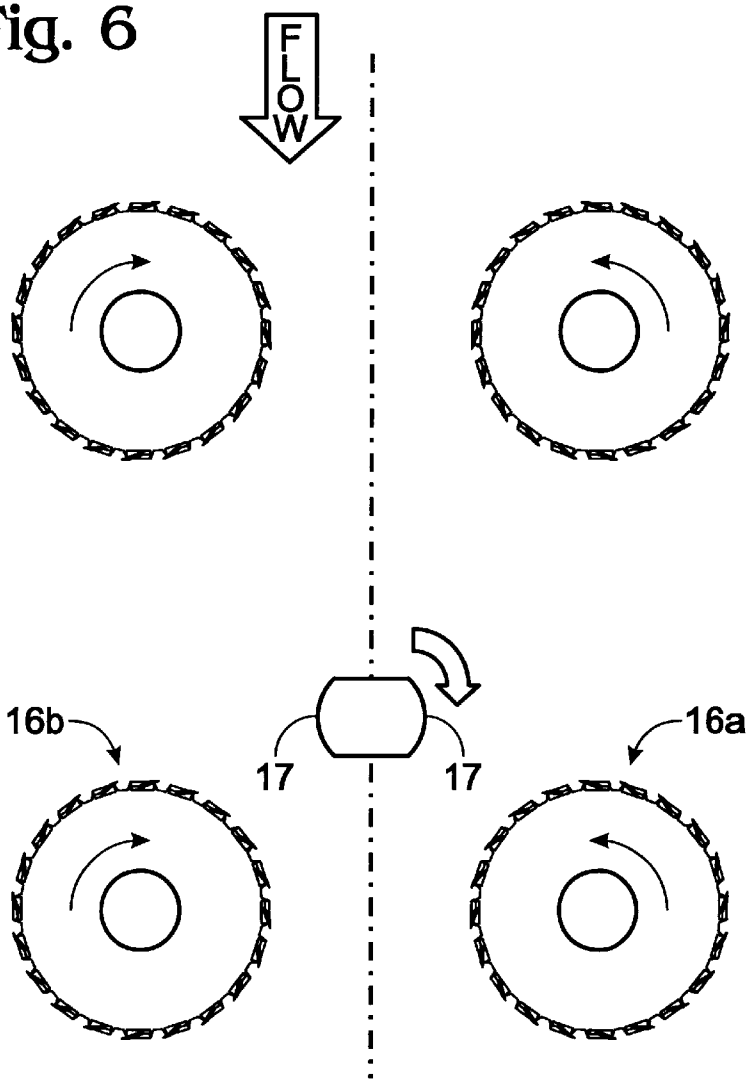
FIG. 6 is an end view of the log and cutting heads of FIG. 1 according to the present invention in a sixth position of the log.

Turning to FIG. 6, the log 18 is rotated 90 degrees about its elongate axis "e" in preparation for cutting two additional surfaces from the remaining, unfinished sides 17 of the log. The steps described above in connection with FIGS. 1–5 may be repeated by employing the cutting heads 14 to cut these additional surfaces. However, to increase throughput and speed, it is preferable to provide a second pair of like cutting heads 16*a* and 16*b*, wherein the steps described above in connection with the heads 14*a* and 14*b* are carried out with the heads 16.

Figure 8:
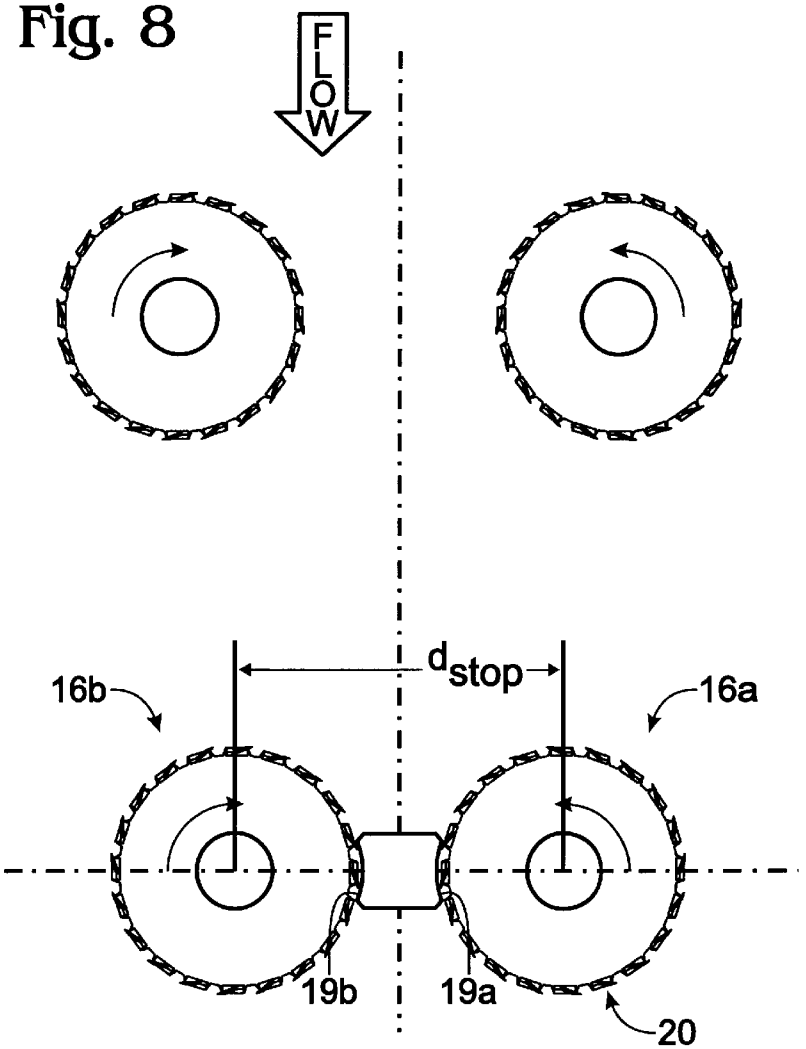
FIG. 8 is an end view of the log and cutting heads of FIG. 1 according to the present invention in an eighth position of the log.
Figure 7:
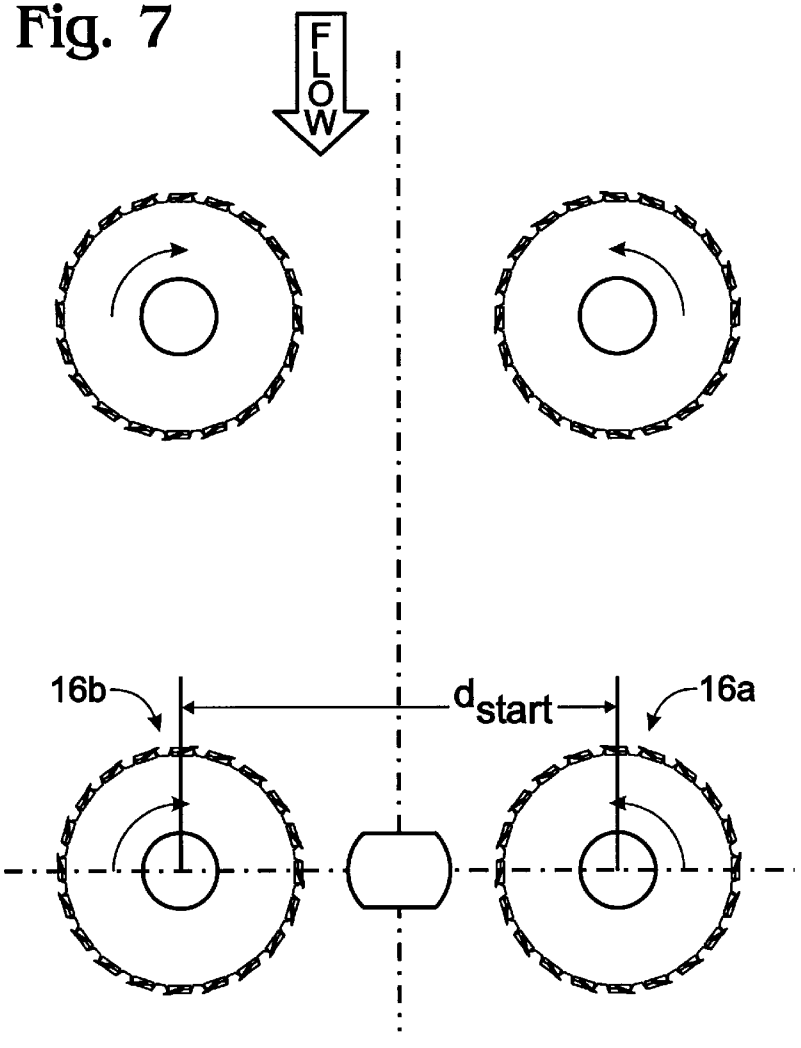
FIG. 7 is an end view of the log and cutting heads of FIG. 1 according to the present invention in a seventh position of the log.
Figure 10:
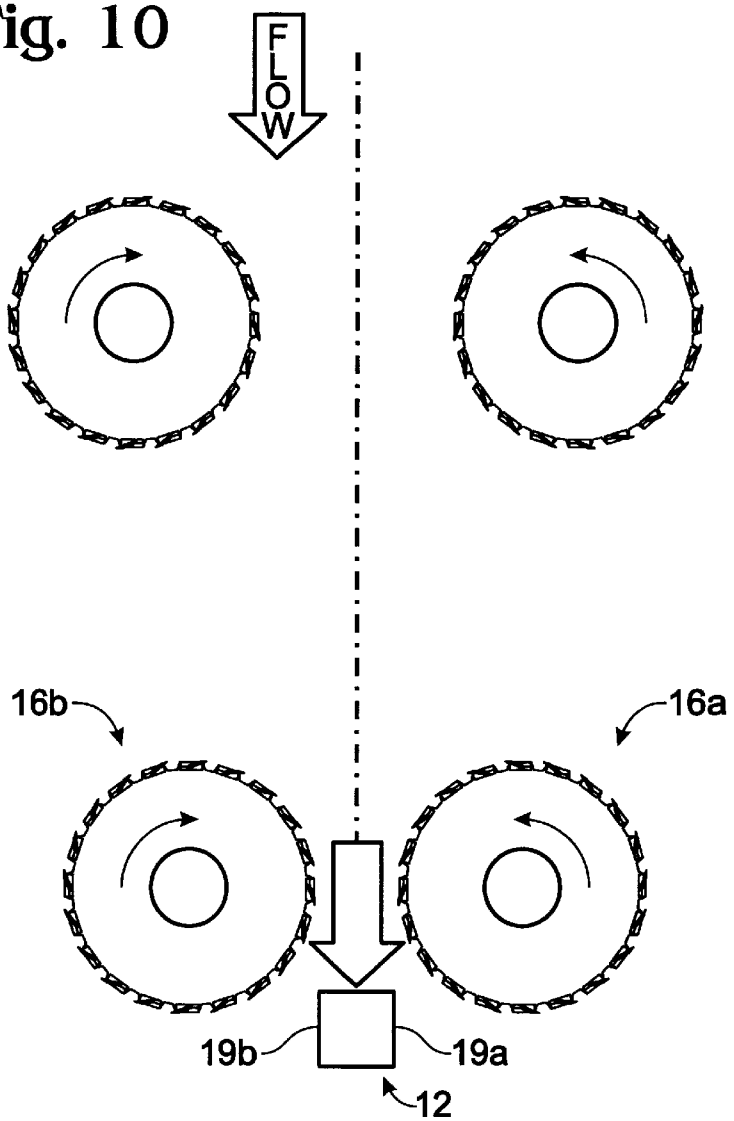
FIG. 10 is an end view of the log and cutting heads of FIG. 1 according to the present invention in a tenth position of the log.
Figure 9:
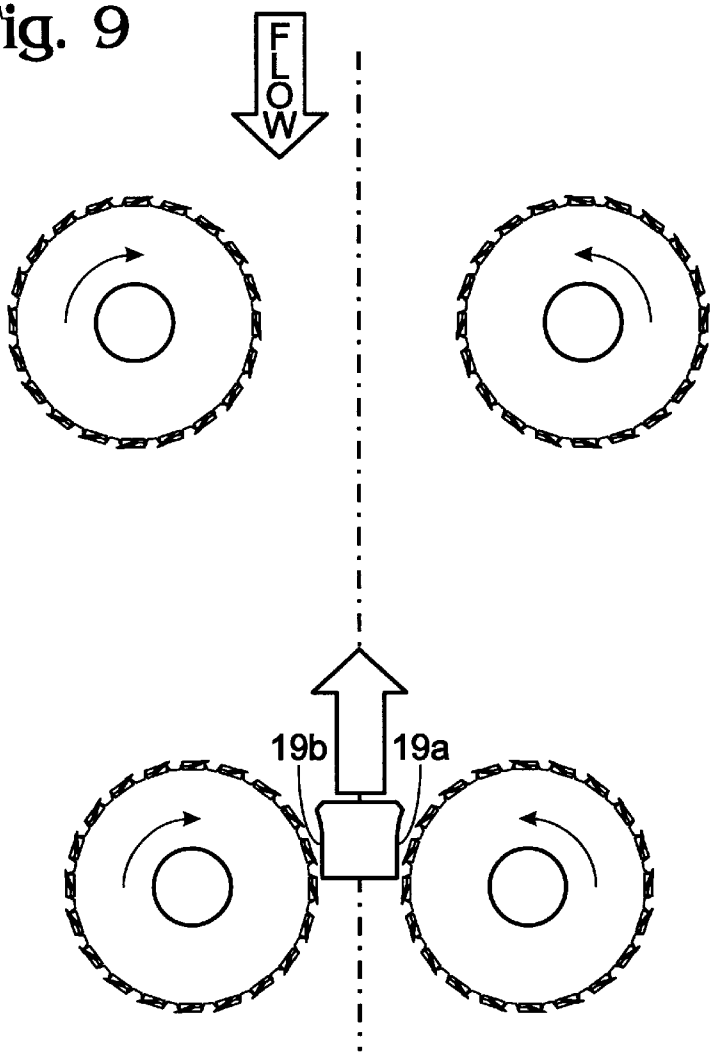
FIG. 9 is an end view of the log and cutting heads of FIG. 1 according to the present invention in a ninth position of the log.

Turning to FIG. 7, the log 18 is positioned between the heads 16 as it was positioned in FIG. 2 with respect to the heads 14. Turning to FIG. 8, the heads are relatively translated with respect to the log from a starting distance apart to a stopping distance at which the knives 20 cut curved surfaces 19 in the sides 17 of the log. Turning to FIG. 9, the log is relatively translated perpendicular to the direction of translation of the cutting heads so as to plane a portion of the surfaces 19, and in FIG. 10, the log is relatively translated in the opposite direction to complete the planing of the surfaces 19 and to produce a finished four sided cant 12.

In the above discussion, it was assumed for convenience of description that the four sided cant is either square or rectangular in cross-section, though this is not essential to practice of the invention. Rotations of the log in increments varying from 90 degrees may produce cants of any number of sides and cross-sectional configurations consistent with the principles of the invention.

The rate at which the cutting heads are permitted to move inwardly while cutting the log is adjusted so that each knife 20 takes a cut out of the log that is the desired thickness of the flake or strand, e.g., about 0.020". To achieve a constant flake or strand thickness, the movement of the heads may be at a constant rate, or the heads may indexed a constant amount at discrete times.

Figure 11:
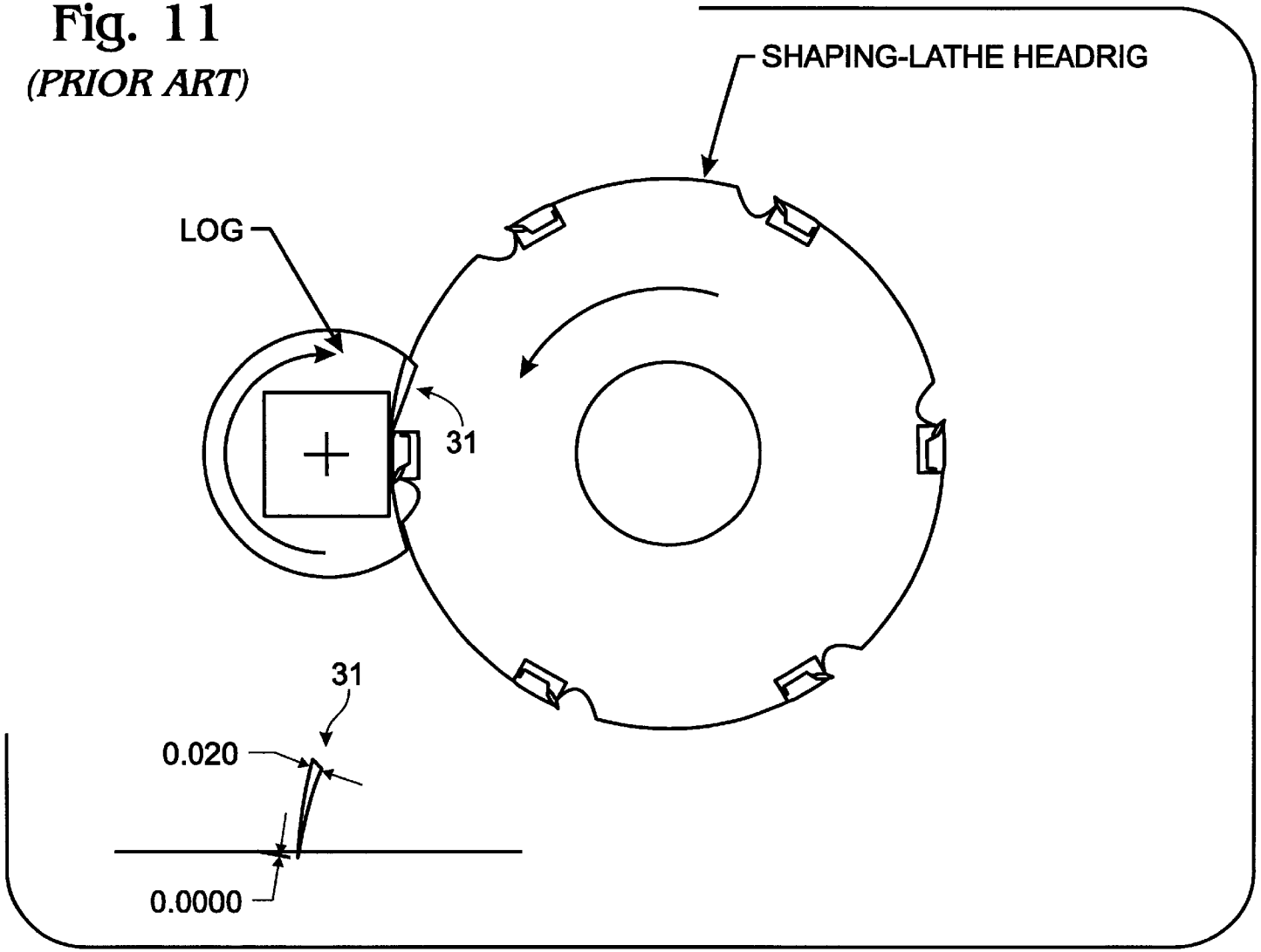
Fig. 11 (PRIOR ART)
FIG. 11 is an end view of a log and cutting head illustrating a method for producing a four sided cant from the log according to the prior art.

The production of a uniform flake or strand thickness as a consequence of a constant cutting head translation speed is an outstanding feature of the present invention. On the shaping lathe headrig, by contrast, the log is rotating at the same time the cutting head is being moved toward or away from the log, resulting in a wedge shaped flake or strand 31 as shown in FIG. 11. Flakes or strands produced by the method and apparatus of the present invention are of greatly superior quality for use in oriented strand board.

Figure 12:
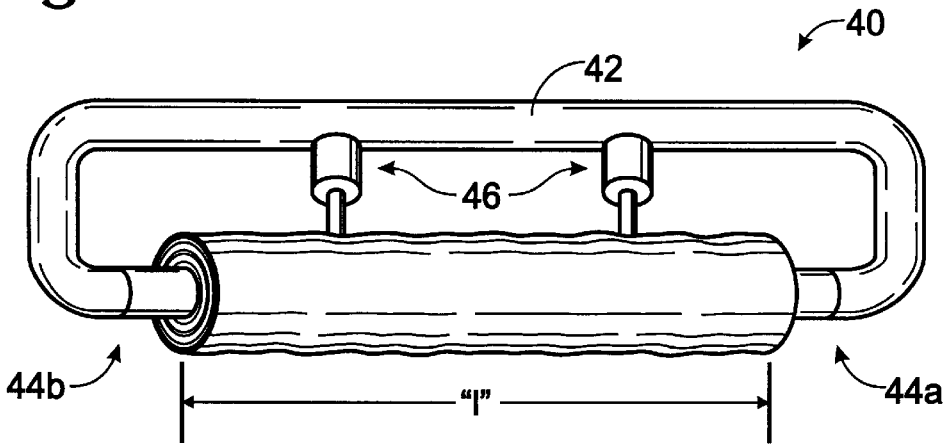
FIG. 12 is a side elevation of a capturing mechanism for capturing the log of FIG. 1 according to the present invention.

Turning to FIG. 12, a mobile carrier 40 may be provided for carrying the log into position between the cutting heads and moving the log as required to plane the cut surfaces. The carrier has a body 42 that extends parallel to the log, and two end members 44*a*, 44*b* for capturing the log at its ends. Preferably, the body incorporates a plurality of stops 46, which extend to make contact with the log at spaced apart locations along the length of the log. At least one of the end members 44*a*, 44*b*, and the stops 46, are adjustable to fit the log, such as by use of hydraulic or pneumatic cylinders. The end member or members are adjusted to capture the log endwise by exerting an axially directed force to the ends of the log, while the stops are adjusted to press against the log in radial directions as desired for holding the log in place against cutting forces and for straightening it. The stops are deployed against surfaces that are not being cut by the heads 16 and the end members 44 permit rotation of the log within the carrier so that the stops may be retracted, the log rotated, and the stops redeployed against surfaces that will not be cut by the heads 24. The stops are particularly advantageous when securing and straightening small diameter logs, which are more flexible than larger diameter logs and are often less straight.

Figure 14:
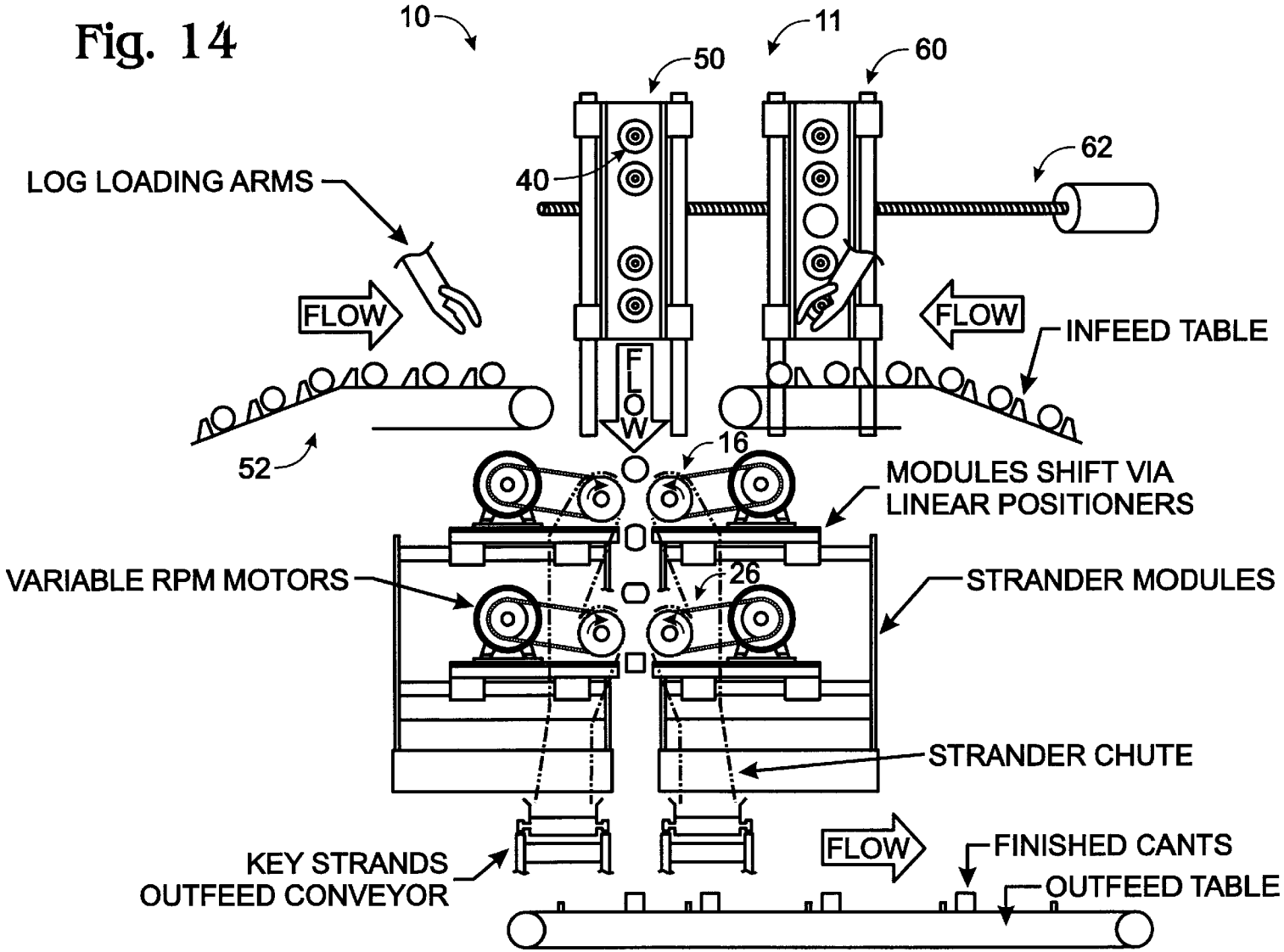
FIG. 14 is a flow diagram illustrating a log flaking and loading method according to the present invention.

Turning to FIG. 14, a log loading method and apparatus 11 according to the present invention is shown. A magazine 50 is provided for stacking a plurality of the carriers 40 and captured logs. A conveyor 52 feeds the logs to the magazine, each log being picked up and placed into a corresponding carrier 40 for placement into the magazine. The loaded carriers are moved first-in-first-out ("FIFO") from the magazine and past the cutting heads 16. As mentioned above, the log is preferably rotated within the carriers to permit the use of stops to assist both pairs of cutting heads.

Preferably, the carriers are positioned in the magazine so that the logs are disposed side-by-side, so that they are dispensed from the magazine in a direction that is perpendicular to their elongate axes. This provides for staging the logs relatively compactly as well as for faster rates of delivery to the cutting heads.

Preferably, a second magazine 60 is provided to increase speed of production still further. While the logs are being emptied from one of the magazines, the other magazine may be being loaded, the empty magazine being switched with the freshly loaded magazine. A replacement mechanism 62 is provided for switching the magazines, which may be implemented in any of a variety of forms well known to those of ordinary skill in the mechanical arts.

The flakes or strands produced in the above cutting processes are of a generally high quality in terms of strength and robustness. However, in another aspect of the invention, this quality is improved further at the sacrifice of the capability to produce four sided cants. According to this aspect of the invention, a single rotating cutting head such as the cutting head 16*a* described above may be provided for relative translation toward a log that is, preferably, counter-rotating about its elongate axis. No cam is employed, so that flakes or strands are "peeled" from the log and cut off without the log losing its round cross-sectional configuration. These flakes or strands have a high density of parallel grain fibers wherein substantially all of the fibers on a flake or strand belong to the same ring of growth. Parallel grain fibers are generally stronger and more robust than flakes or strands having cross-cut grain, and cutting from a single ring of grain provides for a greater density of grain fibers.

It is to be recognized that, while a specific log flaking and loading method and apparatus has been shown and described as preferred, other configurations could be utilized, in addition to configurations already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A method for flaking a log having an elongate axis, comprising:

(a) providing a first pair of cutting heads, each cutting head carrying one or more knives;

(b) rotating each of the cutting heads about respective, substantially parallel axes;

(c) disposing the log between the cutting heads so that its elongate axis is substantially parallel to said axes and lies in the same, first plane;

(d) relatively translating the cutting heads from a starting distance apart to a smaller distance apart so as to cut two curved surfaces into opposite sides of the log with said knives; and (e) relatively translating the log with respect to the first pair of cutting heads in a direction substantially perpendicular to said plane.

2. The method of claim 1, wherein step (d) is stopped during the time step (e) is conducted, for planing said surfaces.

3. The method of claim 2, wherein step (c) includes disposing the log substantially mid-way between the cutting heads, and wherein step (d) includes moving each of the cutting heads toward the other substantially equal amounts.

4. The method of claim 1, wherein step (e) includes translating the log in said direction perpendicular to said plane while said axes of said second pair of cutting heads remain in said plane.

5. The method of claim 2, further comprising a step (f) of relatively translating the cutting heads back to said starting distance apart after completing step (e).

6. The method of claim 5, further comprising a step (g) of rotating the log about its elongate axis after completing step (e).

7. The method of claim 6, wherein, in step (g), said rotating rotates the log about 90 degrees.

8. The method of claim 6, further comprising repeating steps (c), (d) and (e).

9. The method of claim 7, further comprising repeating steps (c), (d) and (e), and commencing steps (d) and (e) after completing step (g).

10. The method of claim 1, further comprising (f) providing a second pair of cutting heads, each carrying one or more knives, (g) rotating the cutting heads of said second pair about respective axes that are substantially parallel to said axes of the cutting heads of said first pair, (h) rotating the log about its elongate axis after completing step (e), (i) disposing the log between the cutting heads of said second pair so its elongate axis is substantially parallel to said axes of the cutting heads of said second pair and lies in the same, second plane, (j) relatively translating the cutting heads of said second pair from a starting distance apart to a smaller distance apart so as to cut two additional curved surfaces into additional opposite sides of the log, and (k) relatively translating the log with respect to the second pair of cutting heads in a direction perpendicular to said second plane.

11. The method of claim 9, wherein said second plane is parallel to said first plane.

12. The method of claim 10, wherein, in step (h), said rotating rotates the log about 90 degrees.

13. A method for producing high quality flakes or strands from a log processed with a flaking apparatus having a rotating cutting head, comprising disposing the log so that the elongate axis of the log is substantially parallel to the axis of rotation of the cutting head and lies in the same plane, rotating the log about its elongate axis, and relatively translating the cutting head and the log from a starting distance apart to a smaller distance apart so as to cut the log along its circumference.

14. The method of claim 12, further comprising rotating the cutting head and log in opposite directions.

* * * * *